US007243483B2

(12) United States Patent
Clüsserath et al.

(10) Patent No.: US 7,243,483 B2
(45) Date of Patent: Jul. 17, 2007

(54) BEVERAGE BOTTLING PLANT FOR FILLING CONTAINERS, SUCH AS BOTTLES AND CANS, WITH A LIQUID BEVERAGE, A FILLING MACHINE FOR FILLING CONTAINERS WITH A LIQUID, AND A METHOD FOR FILLING CONTAINERS WITH THE FILLING MACHINE

(75) Inventors: Ludwig Clüsserath, Bad Kreuznach (DE); Volker Till, Hofheim/Taunus (DE); Dieter-Rudolf Krulitsch, Bad Kreuznach (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 0 days.

(21) Appl. No.: 11/045,813

(22) Filed: Jan. 28, 2005

(65) Prior Publication Data

US 2005/0188654 A1 Sep. 1, 2005

(30) Foreign Application Priority Data

Jan. 29, 2004 (DE) ..... 10 2004 004 331

(51) Int. Cl.
*B65B 3/04* (2006.01)
*B67C 3/28* (2006.01)

(52) U.S. Cl. ..... 53/473; 53/278; 141/290

(58) Field of Classification Search ..... 53/473, 53/266.1, 272, 277, 278, 167; 141/290, 285, 141/2, 10, 192, 198
See application file for complete search history.

(56) References Cited

U.S. PATENT DOCUMENTS 3,430,639 A 3/1969 Roberts
3,797,535 A * 3/1974 Kaiser ..... 141/198
3,825,043 A * 7/1974 Fechheimer et al. ..... 141/147
3,834,429 A * 9/1974 Schulz ..... 141/83
4,964,444 A * 10/1990 Hanerus et al. ..... 141/90
5,224,526 A * 7/1993 Mette et al. ..... 141/285
5,634,500 A * 6/1997 Clusserath et al. ..... 141/7
5,865,225 A * 2/1999 Weiss ..... 141/198
5,960,838 A * 10/1999 Tietz et al. ..... 141/144
6,070,622 A * 6/2000 Rutter ..... 141/90
6,148,874 A * 11/2000 Rutter et al. ..... 141/90
6,453,953 B1 * 9/2002 Adriansens et al. ..... 141/290

(Continued)

FOREIGN PATENT DOCUMENTS

DE 43 44 614 A1 6/1995

(Continued)

*Primary Examiner*—Louis Huynh
(74) *Attorney, Agent, or Firm*—Nils H. Ljungman & Associates

(57) ABSTRACT

A method for hot bottling of a liquid in bottles, kegs or similar containers using a filling machine that has a plurality of filling elements, each filling element has a liquid duct disposed at a dispensing opening and a valve for dispensing the hot liquid to the container, the liquid being bottled in the filling elements is substantially continuously conveyed in the hot condition in a circuit comprising a flow path that includes the filling elements and the liquid ducts from a source for the hot liquid being bottled to a reservoir during an interruption of the filling process in order to reduce the cooling of the liquid being bottled in the filling elements and/or to prevent the cooling of the filling elements.

20 Claims, 9 Drawing Sheets

U.S. PATENT DOCUMENTS 6,463,964 B2 * 10/2002 Clusserath ..... 141/40
6,474,368 B2 * 11/2002 Clusserath et al. ..... 141/198

FOREIGN PATENT DOCUMENTS

DE 201 05 716 U1 7/2002
JP 4102586 4/1903
JP 2001122394 5/2001
JP 2005198001 7/2005
WO WO 2004/056693 7/2004

* cited by examiner

BEVERAGE BOTTLING PLANT FOR FILLING CONTAINERS, SUCH AS BOTTLES AND CANS, WITH A LIQUID BEVERAGE, A FILLING MACHINE FOR FILLING CONTAINERS WITH A LIQUID, AND A METHOD FOR FILLING CONTAINERS WITH THE FILLING MACHINE

BACKGROUND

1. Technical Field

The present application relates to a beverage bottling plant for filling containers, such as bottles and cans, with a liquid beverage, a filling machine for filling containers with a liquid, and a method for filling containers with the filling machine.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus being configured to introduce a predetermined volume of liquid beverage filling material into the interior of bottles to a substantially predetermined level of liquid beverage filling material, and the apparatus configured to introduce a predetermined flow of liquid beverage filling material comprising apparatus being configured to terminate the filling of beverage bottles upon liquid beverage filling material reaching said substantially predetermined level in bottles. There may also be provided a conveyer arrangement being configured and disposed to move bottles, for example, from an inspecting machine to the filling machine. Upon filling, a closing station closes filled bottles. There may further be provided a conveyer arrangement configured to transfer filled bottles from the filling machine to the closing station; as well as a loading station that is configured to load filled bottles into containers, for example, in a six-pack arrangement. There may also be provided a conveyor arrangement configured to transfer filled bottles from the closing station to the loading station.

The hot bottling of a liquid substance, i.e. the dispensing of the liquid at high temperatures, e.g. in the range between 75° C. to approximately 100° C., into bottles or similar containers is described in the prior art.

In particular, the prior art describes the hot bottling of beverages, e.g. fruit juices, to produce a sterile bottled product that is of high quality and has a sufficiently long shelf life. The hot liquid being bottled is thereby fed into the individual containers via the filling elements.

As a result of the high temperature of the liquid to be bottled and the high temperature of the filling elements caused by the liquid in the normal course of the filling process, not only are any harmful germs that may be present in the containers killed, but germs or the formation of germs in the liquid being bottled and in the filling elements are also prevented.

During hot bottling, however, it is impossible to prevent interruptions of the filling process, for example as a result of disruptions in the feed of the empty containers and/or during the removal of the filled containers. During such interruptions, there is a risk of cooling of the liquid that is then held back in the closed filling elements or is just approaching the closed filling elements, as well as a cooling of the filling elements themselves, so that the germs in the liquid and in the filling elements that can contaminate the liquid being bottled can no longer be reliably killed and/or prevented.

OBJECT OR OBJECTS

The object of the present application is to overcome this disadvantage, and to prevent a cooling of the filling elements and of the liquid being bottled during an interruption of the filling process. To accomplish this object, the invention teaches a filling machine and a method as disclosed herein below.

SUMMARY

In the event of an interruption of the hot bottling process, the present application teaches that the filling elements and/or their liquid ducts are closed and connected so that the filling elements with their liquid ducts are located in a well inside a liquid path inside the machine between the source for the liquid being bottled and a well that receives the fluid being bottled so that, as the filling machine is rotating, for example, and with the resulting control of the filling elements and their liquid valves, the hot liquid being bottled continues to flow through the filling elements, thereby preventing a cooling of the filling elements, the cooling liquid that is retained in the filling elements, the growth of germs etc.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the present application are described herein below. The embodiments are explained in greater detail below with reference to the exemplary embodiments illustrated in the accompanying figures, in which.

DESCRIPTION OF EMBODIMENT OR EMBODIMENTS

Figure 1:
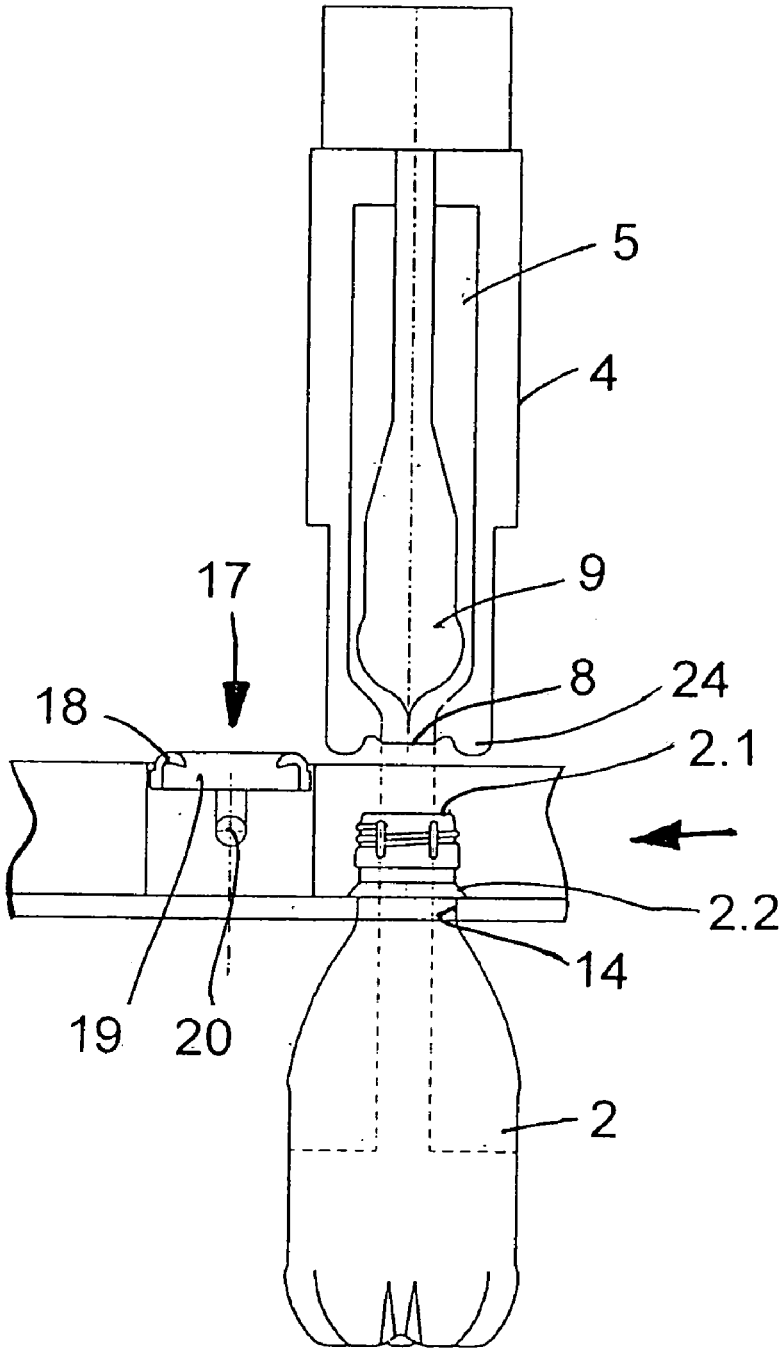
FIG. 1 is a simplified representation of a filling element of a filling machine with a rotating construction for the hot bottling of a liquid, together with a container carrier or bottle carrier and with a bottle provided on said carrier, and specifically in a filling mode of the filling machine.
Figure 1A:
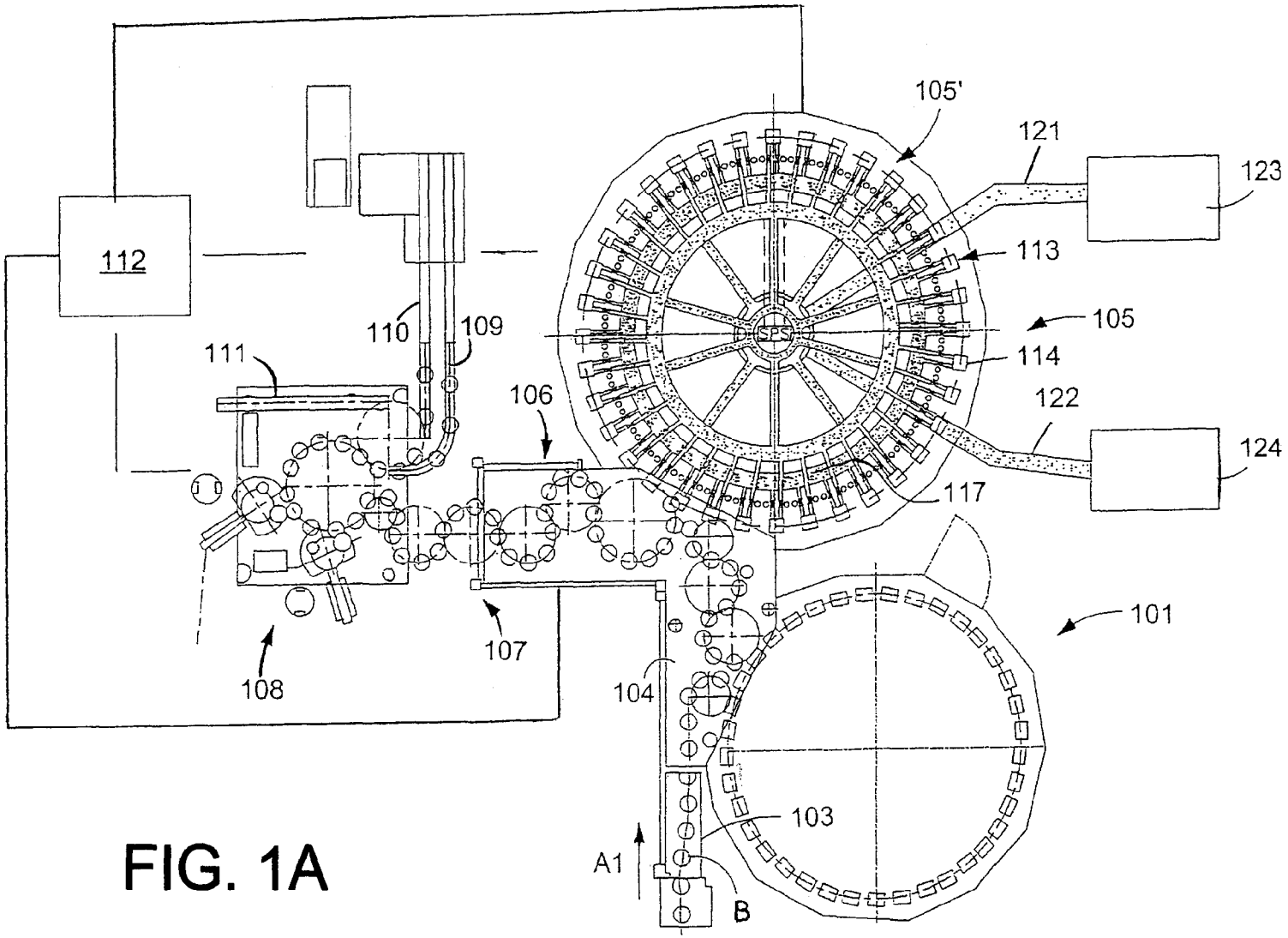
FIG. 1A is a schematic illustration of a container filling plant in accordance with one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

Figure 2:
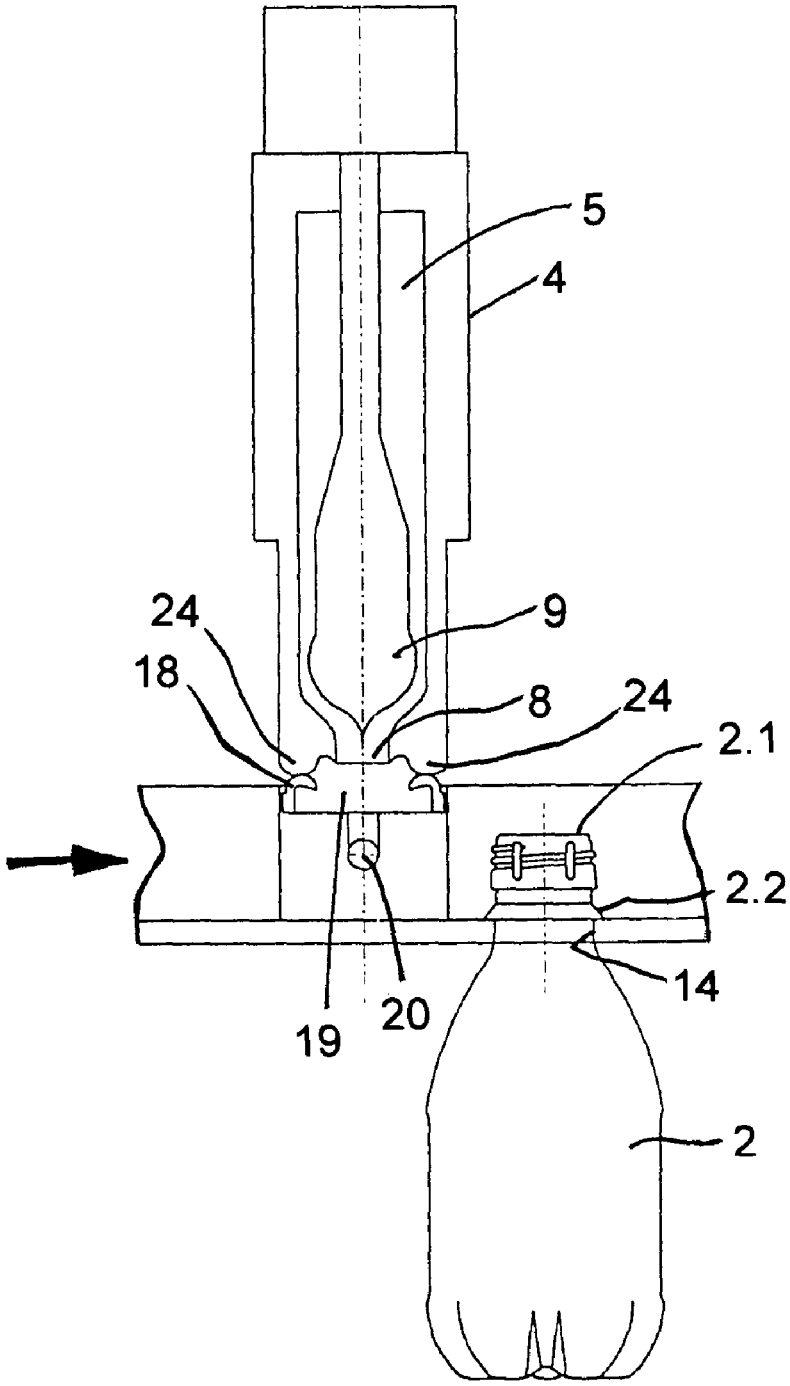
FIG. 2 is an illustration as in FIG. 1, but in a stand-by or interruption mode of the filling machine.
Figure 3:
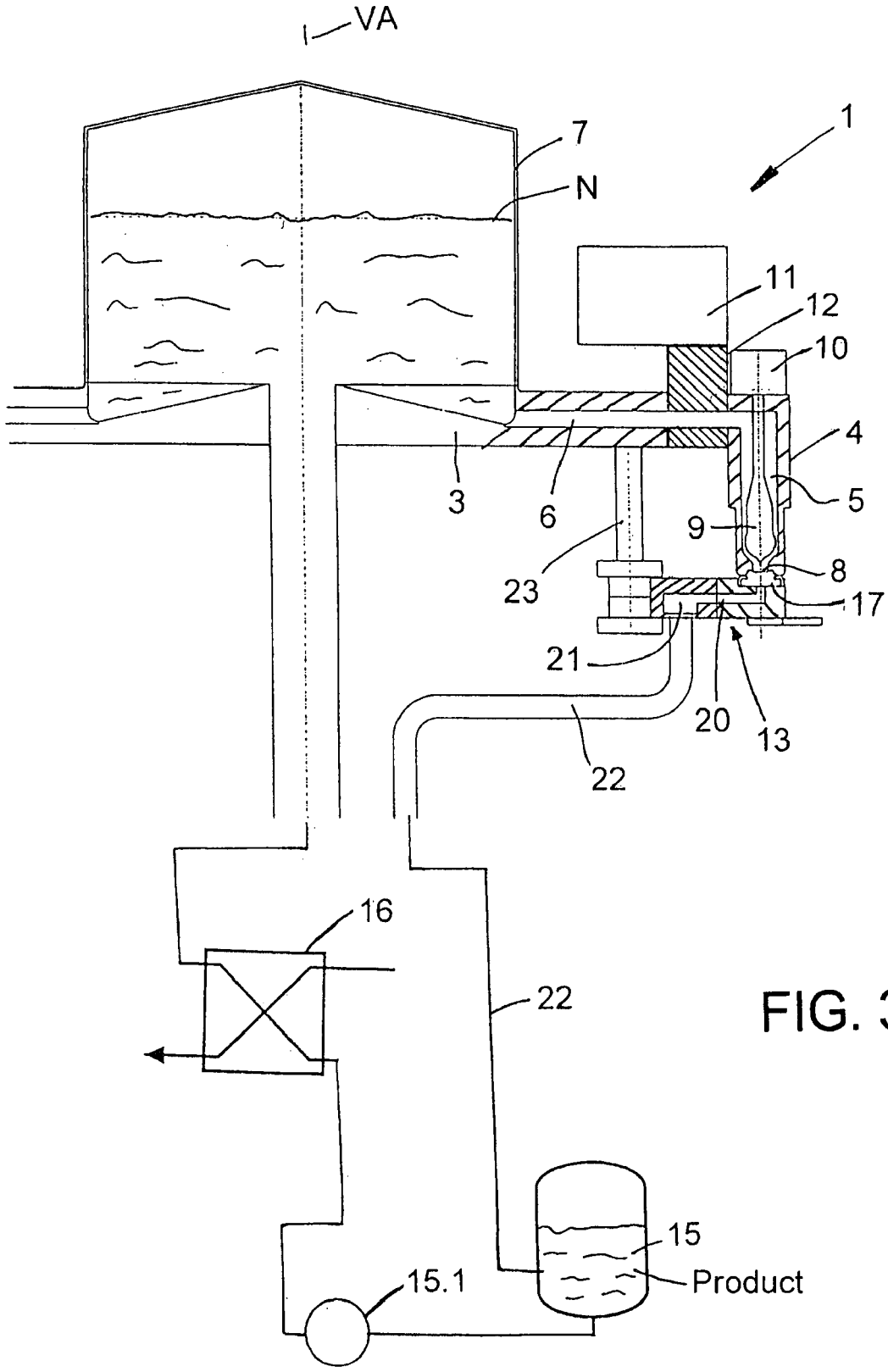
FIG. 3 is a schematic illustration of the rotor of the filling machine rotating around a vertical machine axis, together with a filling element provided on said rotor, and with an associated ring-shaped container carrier or bottle carrier that surrounds the vertical machine axis, in the stand-by or interruption mode of the filling machine.

In FIGS. 1–3, 1 designates a filling machine in general for a hot bottling machine, i.e. for the sterile bottling of a liquid, for example of a fruit juice drink in containers or bottles 2, for example in plastic or PET bottles. The filling machine 1, in the manner of the prior art, on the circumference of a rotor 3 that can be driven so that it rotates around a vertical machine axis VA, has a plurality of filling elements 4, which are provided there at uniform angular intervals around the axis VA and each of which forms, in a filling element housing, a liquid duct 5, which is connected with its upper end via a line 6 with the interior of a boiler 7 that is provided on the rotor 3. The lower end of each liquid duct 5, on the underside of the respective filling element 4, forms a dispensing opening 8 for the controlled dispensing of the liquid into the bottle 2 provided on the filling element. In the liquid duct 5, in a manner described in the prior art, there is a fluid valve 9, which is controlled by means of an actuator element 10 by a control device 11 as a function of signals from a flowmeter 12 that is provided in the line 6, and in particular for a volume-controlled filling of the bottles 2.

Underneath the filling elements, on the tube 3 there is a container carrier or bottle carrier 13, which in the illustrated embodiment is formed by a ring that concentrically surrounds the axis VA and has a plurality of receptacles 14, into each of which a bottle 2 on a bottle inlet of the filling machine 1 is inserted radially and can be removed radially after filling at a bottle outlet. The receptacles 14 are realized so that each bottle 2 that is located in a receptacle 14 is suspended on the container carrier 13 by means of a flange-like bottle segment 2.2 which is located slightly below the bottle mouth 2.1, so that the axis of the dispensing opening 8 is equi-axial with the axis of the bottle 2, but the mouth 2.1 is at some distance from the dispensing opening 8 and thus, during the filling under atmospheric pressure, the air displaced out of the bottle 2 by the liquid can escape from the mouth of the bottle 2.1.

The vessel 7 contains the liquid being bottled at such a high temperature that a hot and thus essentially sterile bottling of the liquid into the bottles 2 via the filling elements 4 is achieved. The liquid being bottled is fed at a controlled level to the vessel 7 from a reservoir 15 that is located outside the filling machine 1 via a heater 16 also provided outside the filling machine 1, namely so that the level of liquid in the vessel 7 is maintained at a specified level N. Additional heating means are provided in the boiler 7, for example, to keep the liquid at the required temperature in the boiler 7.

For sterile bottling, it is necessary, among other things, for the liquid in the feed line 6 and in the filling elements 4, but also for these lines 6 and the filling elements 4 themselves, at least on the surfaces that come into contact with the liquid during bottling, to be heated to prevent the formation of germs and to kill germs. This germ-killing action is guaranteed during the normal filling process.

However, if there is an interruption in the filling process, it is not possible without additional measures to maintain the required temperature of the liquid being bottled that is located in, among other places, the feed lines 6 and in the filling element 4, or the required temperature of, among other things, these feed lines 6 and filling elements 4, i.e. to prevent a cooling of, among other things, the liquid being bottled, the feed lines 6 and the filling elements 4. To overcome this disadvantage, when there is an interruption, the filling machine 1 makes it possible to switch over from the conventional filling mode to a stand-by or interruption mode in which the filling elements 4 continue to be flowed through by the hot liquid being bottled, and in particular, for example, as the rotor continues to turn and during which time the liquid that is discharged at the dispensing openings 8 is returned to the reservoir 15.

For this stand-by or interruption mode of the operation of the filling machine 1, there are closing or shutter or sealing elements 17 on the ring-shaped container carrier 13, and in particular there is a respective closing element 17 between each two receptacles 14, such that each closing element is provided in a specified peripheral direction of the container carrier 13 and in relation to the axis VA offset from the next by the same angular amount with respect to the associated receptacle 14. In the illustrated exemplary embodiment, the closing elements 17 are located in the middle between two receptacles 14, and are realized in the form of a cap which is open toward the top, and in particular with an O-ring 18 which, among other things, forms the edge of the opening of the respective cap-shaped closing element 17. The interior 19 of each closing element is in communication via a branch duct 20 with a ring duct 21 which, like the ducts 20, is realized in the ring-shaped container carrier 13 and surrounds the axis VA concentrically. The ring duct 21 is connected with the reservoir 15 by means of a line, for example, in the illustrated exemplary embodiment by the line 22.

The container carrier 13, which is located underneath the rotor 3 in the direction of the axis VA, can be pivoted back and forth on this rotor 3 by means of bearing elements 23 around the axis VA by an angular amount, and in particular by a drive (not shown), so that in the one swivel position that corresponds to the filling mode of the filling machine, in the manner described above, there is always a receptacle 14 under each filling element, and in the other swivel position, which corresponds to the stand-by or interruption mode of the filling machine 1, each filling element 4 is tightly closed on its lower end by a closing element 17, into the interior 19 of which the dispensing opening 8 of the respective filling element 4 empties. It is then possible that during an interruption of the filling process, the liquid being bottled, as it flows through the lines 6 and the filling elements 4 to the dispensing openings 8, can be dispensed in a controlled manner, although no longer into the bottles, but into the interior 19 of the associated closing element 17 and from there via the ducts 20 and 21 and the line 22 back to the reservoir 15, from which the liquid to be bottled is then returned to the boiler 7 by the delivery pump 15.1 via the heater 16. As a result, in the event of an interruption of the filling process, a cooling of the liquid being bottled in the feed lines 6, in the filling elements 4 and also a cooling elements of the feed lines 6 and the filling elements 4 themselves, can be effectively prevented.

In other words, in one possible embodiment, the liquid is recirculated through the boiler 7, the feedlines 6, and the filling elements 4 in order to maintain the temperature of the heated liquids and the mechanisms through which the heated liquids flow. As a result, the filling elements 4 and the liquid are maintained at a substantially high temperature, thereby essentially preventing the generation of germs and other contaminants that would contaminate the liquid and the components of the filling machine.

In another possible embodiment, when the closing element 17 is not in use, for instance, when the filling machine is not in interruption mode, some germs may develop in the liquid residue on the closing element 17 that may be left on the closing element 17 after a liquid has been conducted through the closing element 17. However, when the filling machine is returned to interruption mode, the germs that may have developed on the closing element 17 will be essentially eliminated when the heated liquid is circulated, thus heating the closing element 17 and killing substantially all of the germs.

In the position of the container carrier 13 that corresponds to the interruption mode, to achieve a tight closure for each filling element 4 by the associated closing element 17, each filling element 4 is provided on its underside with a ring-shaped bead 24 which surrounds the dispensing opening 8 at some distance, but is equi-axial with the dispensing opening 8, against which, during the interruption mode, the seal 18 of the associated closing element 17 is pressed tightly against a segment that forms a lip seal.

In another possible embodiment, the seal 18 could be an elastic, resilient seal. In this possible embodiment, the seal 18 could project outwardly and could be configured and disposed to come into contact with the ring-shaped bead or protrusion 24. The seal 18 could be made of an elastic or resilient material, the elasticity or resiliency of which could permit the ring-shaped bead or protrusion 24 to be slid or moved into contact with the seal 18, yet still permit adequate pressure for a seal to be formed.

Figure 2A:
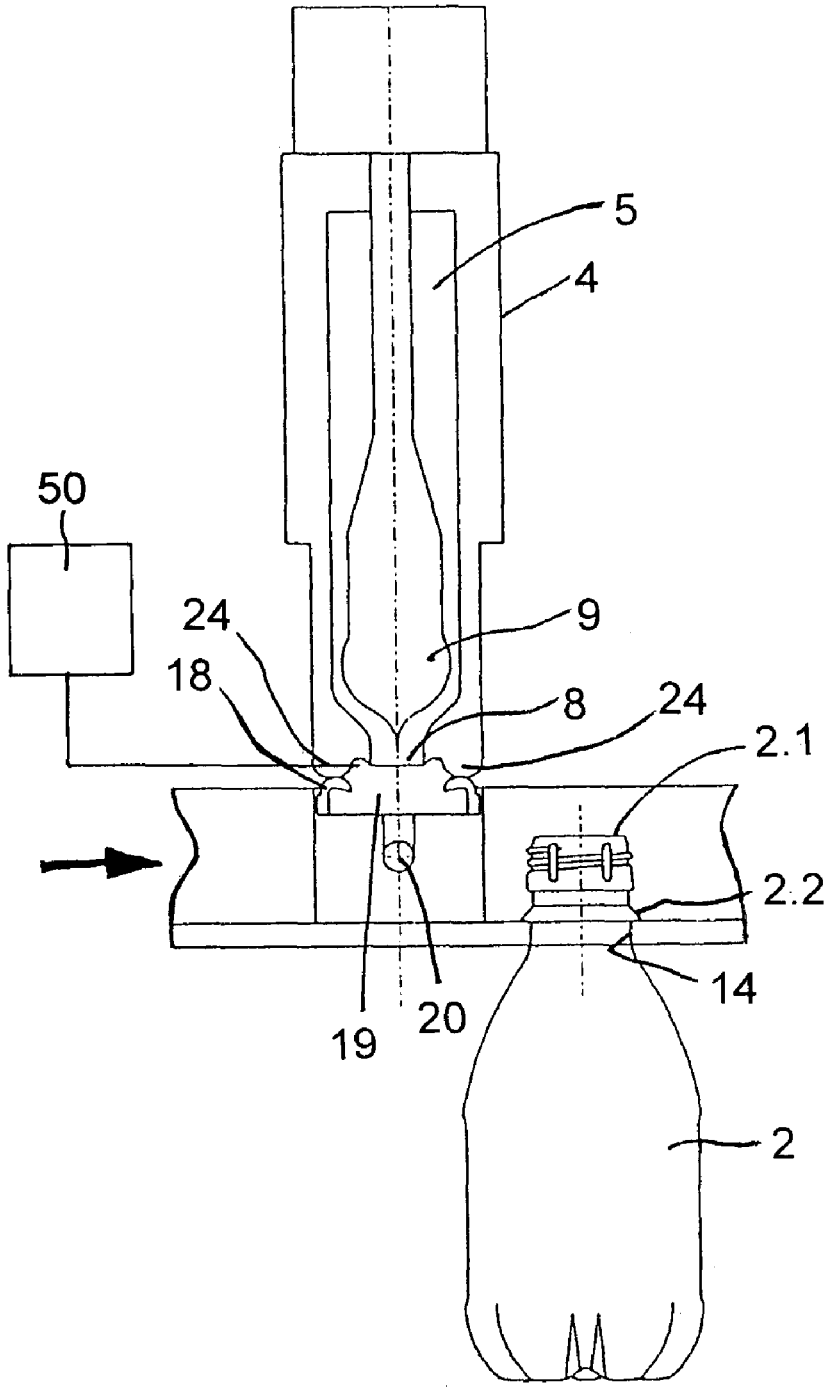
FIG. 2A shows a possible embodiment in stand-by or interruption mode, with a box representing a possible lifting element.
Figure 2B:
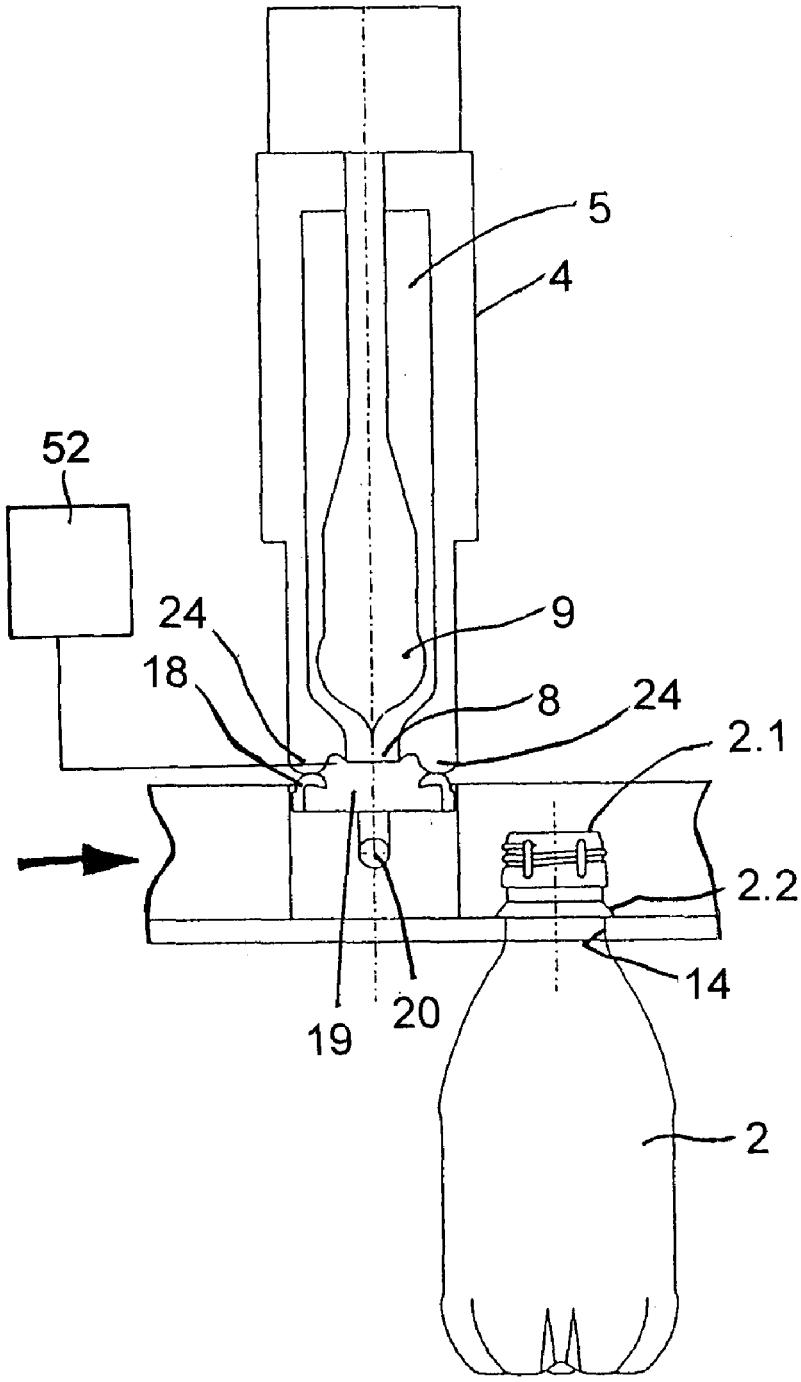
FIG. 2B shows a possible embodiment in stand-by or interruption mode, with a box representing a possible driving element.

In an additional possible embodiment, the seal 18 could be further secured by a lifting element 50. In FIG. 2A, a box represents a lifting element 50 in one possible embodiment, used to exert pressure or force on the seal 18 in order to bring the seal 18 into contact with and engaged with the dispensing opening 8, thus forming a more secure lip seal. In another possible embodiment shown in FIG. 2B, a driving element or rotating element 52 could drive the seal 18 to come into contact with and engage with the dispensing opening 8, thus forming a more secure lip seal.

Figure 4:
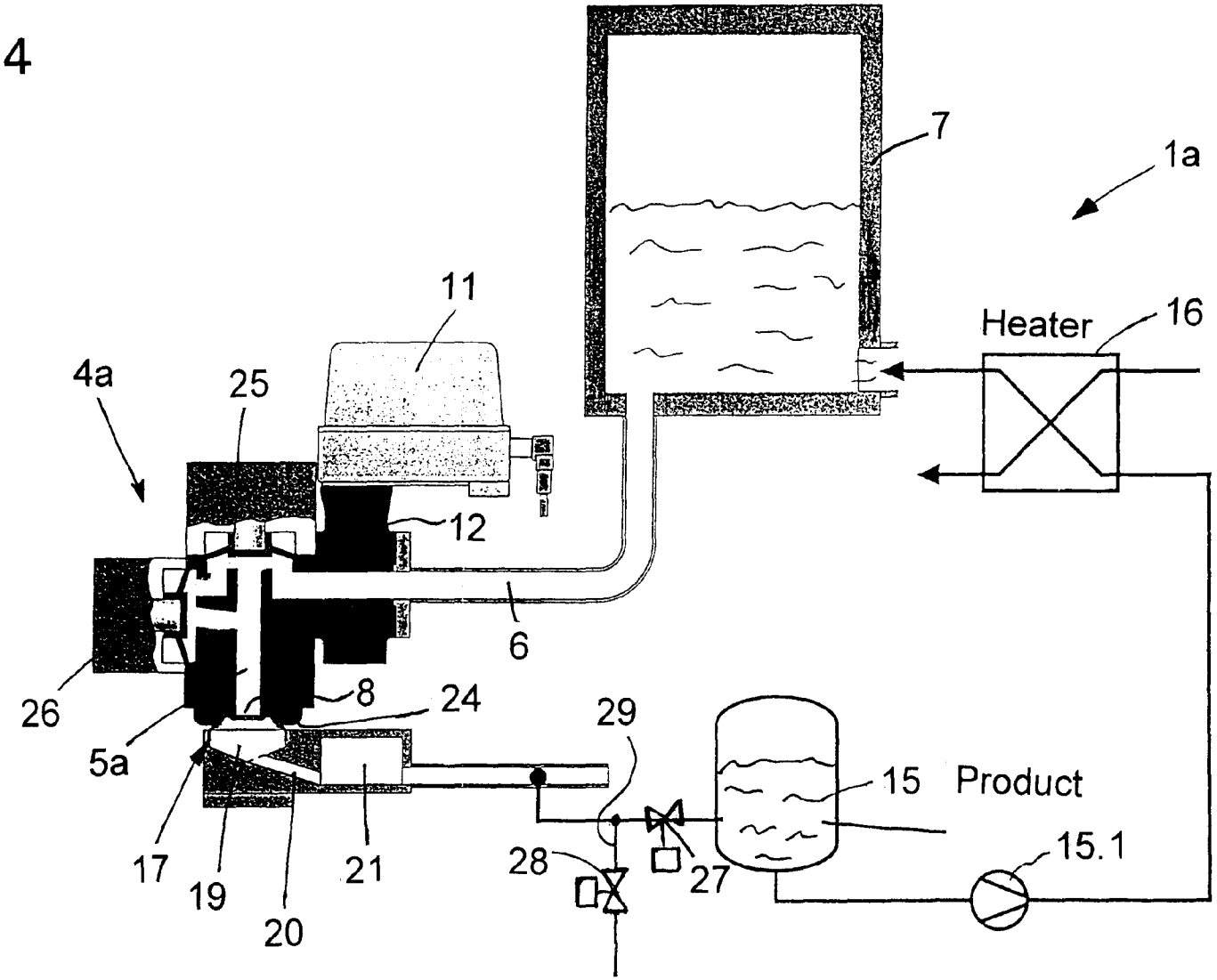
FIG. 4 is a schematic illustration of a filling element, together with additional functional elements of a filling machine with a rotating construction for the hot bottling of a liquid in an additional possible embodiment, and in particular again in the stand-by or interruption mode of the filling machine.

FIG. 4 shows, by way of an additional possible embodiment and in a highly simplified manner, a filling element 4a of a filling machine 1*a* with a rotating construction which is otherwise illustrated only schematically, whereby there are a plurality of filling elements 4*a* on the periphery of a rotor that is not shown in FIG. 4 that can be driven in rotation around a vertical machine axis and having the boiler 7. Also provided on the rotor is a pivoting container carrier 13 on the rotor that can move relative to the rotor around the vertical machine axis between a position that corresponds to the filling mode and a position that corresponds to the interruption mode.

Essentially only the filling element 4*a* is realized differently from the filling element 4, i.e. on the filling elements 4*a*, in the liquid duct 5*a* for the liquid being bottled, instead of the liquid valve 9 with the valve body that can move in the vertical direction, there are two individually controllable membrane-type liquid valves 25 and 26, and in particular so that they function in parallel to each other. During the filling mode, at the beginning of the filling phase, i.e. until the positioning of the respective bottle 2 below the filling element 4*a*, both liquid valves 25 and 26 are closed. For a subsequent rapid filling, both liquid valves 25 and 26 are opened. For a slower filling at the end of the respective filling phase, one liquid valve, namely the liquid valve 26, is closed, and in particular before the closing of the liquid valves 25 at the end of the filling phase.

In the stand-by and interrupt mode illustrated in FIG. 4, in which again each filling element 4*a* is closed on the underside by a closing element 17, both filling elements 25 and 26 are opened, so that the entire liquid duct realized in the filling elements 4*a*, including the liquid valves 25 and 26, continues to carry the flow of the hot liquid to be bottled and is thus also heated.

The liquid valves 25 and 26 are in turn actuated by the control unit 11, and in particular as a function of the rotational position of the filling machine 1*a* or its rotor, and during the filling mode, also as a function of the measurement signal from the flowmeter 12.

FIG. 4 shows two shut-off valves 27 and 28, which can be actuated by electric motors or electromagnetically, for example, and namely the valve 27 in the line 22 and the valve 28 in a line 29 that empties into the line 22 between the ring duct 21 and the valve 27. This valve makes possible a CIP cleaning of the filling machine 1 or 1*a*, including at least the boiler 7, the lines 6, the filling elements 4 and 4*a*, the closing elements 17, the ducts 20 and 21 and the heater 16. For this purpose, with the valve 27 closed and the valve 28 open, the liquid cleaning medium, e.g. water but also cleaning media that contain cleaning additives, used for the CIP cleaning can be fed in via the line 29. If the valves 27 and/Or 28 are controlled in a different way, it is also possible to perform a CIP cleaning of the above mentioned components plus the reservoir 15.

Figure 3A:
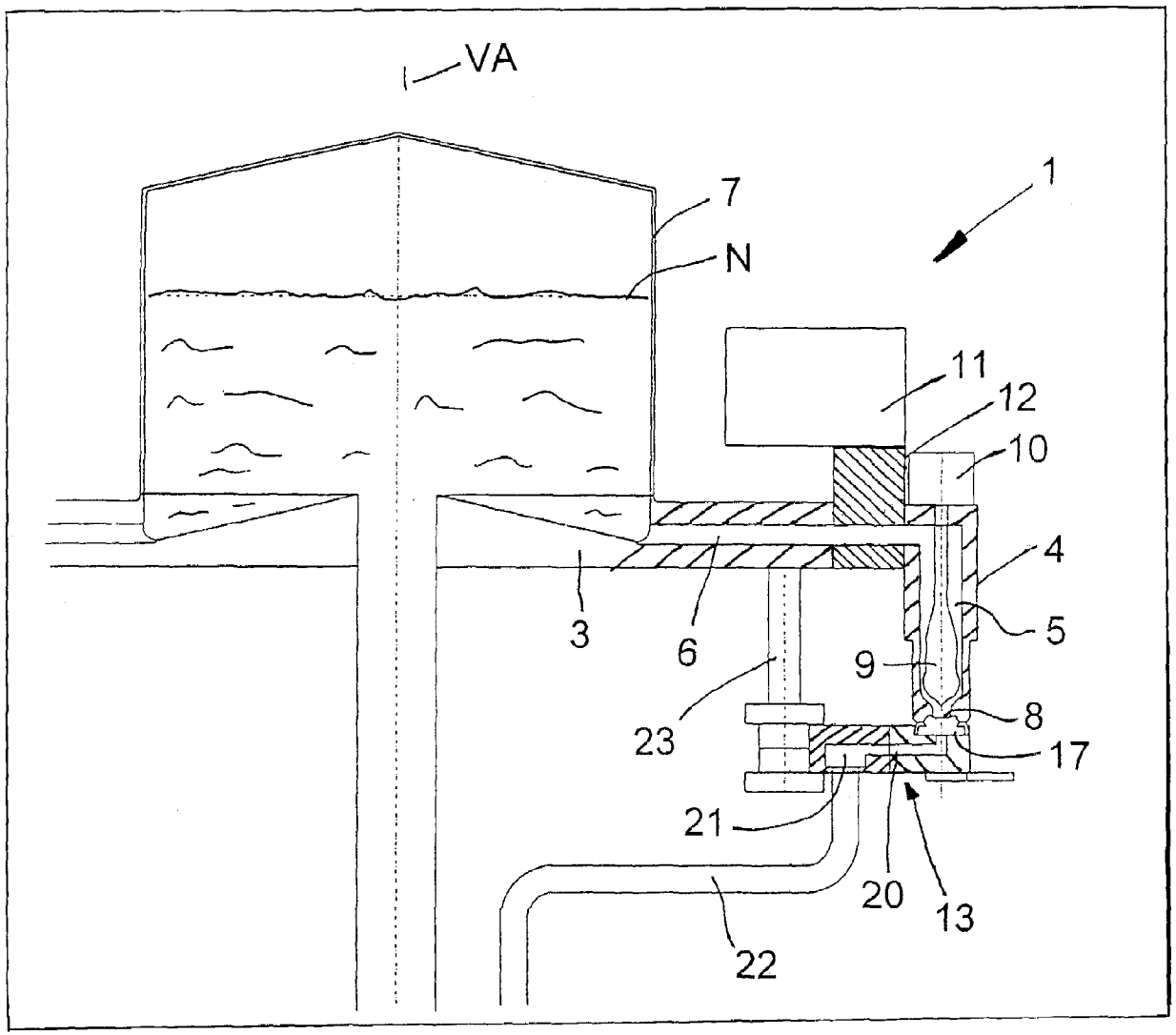
FIG. 3A is similar to FIG. 3, and shows an embodiment enclosed in a clean room.
Figure 4A:
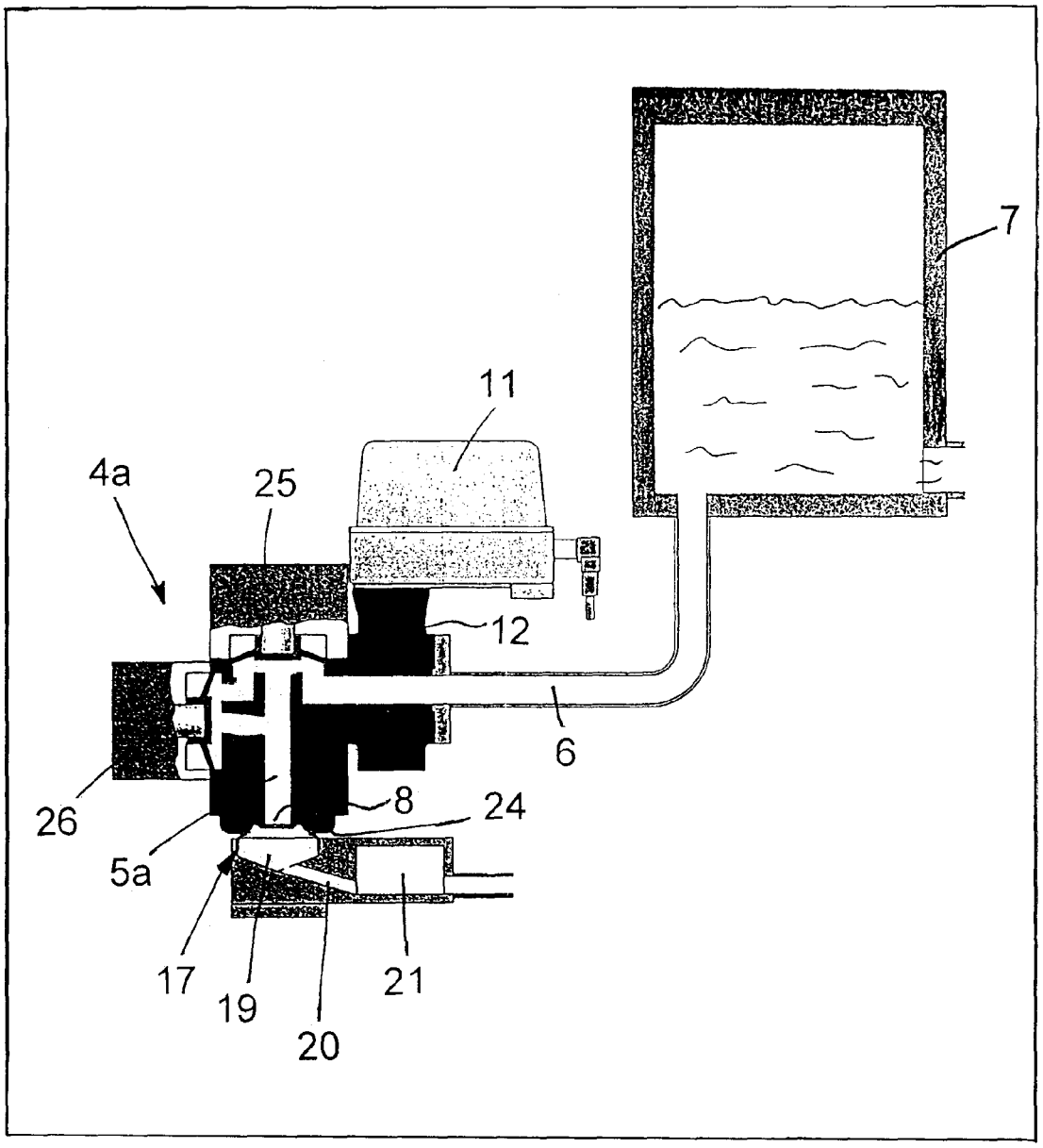
FIG. 4A is similar to FIG. 4, and shows an embodiment enclosed in a clean room.

In another possible embodiment, as shown in FIGS. 3A and 4A, the filling machine could be enclosed in a clean room for the purposes of cleaning the exterior of the filling machine without exposing the filling machine to germs, risking contamination or germ growth in the liquid material for filling containers. The clean room is represented in FIGS. 3A and 4A by a box around the filling machine.

The embodiments have been described above on the basis of exemplary embodiments. It goes without saying that numerous modifications and variations are possible without thereby going beyond the basic teaching of the invention.

The present application relates to a filling method for the hot bottling of a liquid to be bottled in bottles or similar containers using a filling machine with a plurality of filling elements, in the event of an interruption of the filling process, to prevent a cooling of the liquid being bottled in the filling elements and/or of the filling elements themselves, the hot liquid being bottled is transported in a flow path inside the machine that includes these filling elements from a source of the liquid being bottled to a well that receives the liquid being bottled.

One feature or aspect of an embodiment is believed at the time of the filing of this patent application to possibly reside broadly in a method for the hot bottling of a liquid in bottles, kegs or similar containers using a filling machine that has a plurality of filling elements, each of which has a liquid duct that ends at a dispensing opening and has at least one liquid valve for the controlled dispensing of the hot liquid being bottled to a container which is located on the filling element, characterized by the fact that to reduce the cooling at least of the liquid being bottled in the filling elements and/or to prevent the cooling at least of the filling elements during an interruption of the filling process, the liquid being bottled is conveyed in the hot condition in at least one flow path that includes said filling element and/or its liquid ducts from a source for the hot liquid being bottled to a liquid well that receives the liquid being bottled.

Another feature or aspect of an embodiment is believed at the time of the filing of this patent application to possibly reside broadly in a method for the hot bottling of a liquid in bottles, kegs or similar containers, characterized by the fact that to prevent the cooling of at least the liquid being bottled in the filling elements and/or to prevent a cooling at east of the filling elements during an interruption of the filling process, the liquid being bottled is transported hot in a circuit that encloses the flow path inside the machine.

Yet another feature or aspect of an embodiment is believed at the time of the filing of this patent application to possibly reside broadly in a method for the hot bottling of a liquid in bottles, kegs or similar containers, characterized by the fact that the liquid source used is a liquid boiler of the filling machine, which boiler is in communication with the filling elements, for example via connecting lines.

Still another feature or aspect of an embodiment is believed at the time of the filing of this patent application to possibly reside broadly in a method for the hot bottling of a liquid in bottles, kegs or similar containers, characterized by the fact that a reservoir is used as a well for the liquid being bottled, in addition to the liquid boiler.

A further feature or aspect of an embodiment is believed at the time of the filing of this patent application to possibly reside broadly in a method for the hot bottling of a liquid in bottles, kegs or similar containers, characterized by the fact that the liquid being bottled is fed from the liquid source out of the liquid well via at least one heater.

Another feature or aspect of an embodiment is believed at the time of the filing of this patent application to possibly reside broadly in a method for the hot bottling of a liquid in bottles, kegs or similar containers, characterized by the fact that the filling elements, to form at least one flow path, are connected by means of their liquid duct, preferably in the vicinity of the dispensing opening, with a duct that is in communication with the liquid well.

Yet another feature or aspect of an embodiment is believed at the time of the filing of this patent application to possibly reside broadly in a method for the hot bottling of a liquid in bottles, kegs or similar containers, characterized by the fact that the filling elements for the formation of the at least one flow path are each closed on their dispending openings by means of a shut-off element.

Still another feature or aspect of an embodiment is believed at the time of the filing of this patent application to possibly reside broadly in a method for the hot bottling of a liquid in bottles, kegs or similar containers, characterized by the fact that the filling elements are connected via the shut-off elements with the liquid well or with the duct connected to this well.

A further feature or aspect of an embodiment is believed at the time of the filing of this patent application to possibly reside broadly in a method for the hot bottling of a liquid in bottles, kegs or similar containers, characterized by the fact that the at least one flow path in question is a flow path inside the machine.

Another feature or aspect of an embodiment is believed at the time of the filing of this patent application to possibly reside broadly in a filling machine with a rotary construction for the hot bottling of a liquid in bottles, kegs or similar containers using a filling machine with a plurality of filling elements on a rotor that can be driven in rotation around a vertical machine axis, each of which filling elements has at least one liquid duct which is in communication with a liquid source for the hot liquid being bottled and empties into a dispensing opening, with at least one liquid valve in the liquid ducts for the controlled dispensing of the liquid being bottled at the respective containers to be filled, characterized by the fact that to prevent the cooling at least of the filling elements and/or at least of the liquid being bottled, there are means for the closing of the filling elements and for the formation of a flow path inside the machine that includes said filling elements and/or their liquid ducts for the hot liquid being bottled between the source of the liquid being bottled and a liquid well that receives the liquid being bottled.

Yet another feature or aspect of an embodiment is believed at the time of the filing of this patent application to possibly reside broadly in a filling machine, characterized by the fact that the well for the liquid being bottled is an additional tank, e.g. a reservoir.

Still another feature or aspect of an embodiment is believed at the time of the filing of this patent application to possibly reside broadly in a filling machine, characterized by the fact that the source of the liquid being bottled is a boiler, preferably provided on the rotor.

A further feature or aspect of an embodiment is believed at the time of the filing of this patent application to possibly reside broadly in a filling machine, characterized by the fact that the well for the liquid being bottled is in communication by means of at least one heater with the source for the liquid being bottled.

Another feature or aspect of an embodiment is believed at the time of the filing of this patent application to possibly reside broadly in a filling machine, characterized by the fact that the means for closing the filling elements are formed by the shut-off element, whereby each shut-off element is associated with at least one filling element, so that all the filling elements can be closed at the same time.

Yet another feature or aspect of an embodiment is believed at the time of the filing of this patent application to possibly reside broadly in a filling machine, characterized by the fact that the respective shut-off element is realized in the shape of a cap and is in communication by means of at least one duct with the well for the liquid being bottled.

Still another feature or aspect of an embodiment is believed at the time of the filing of this patent application to possibly reside broadly in a filling machine, characterized by the fact that the shut-off elements are provided on the rotor so that they can move between one position that closes the filling element and one position that does not close the filling element.

A further feature or aspect of an embodiment is believed at the time of the filing of this patent application to possibly reside broadly in a filling machine, characterized by the fact that the shut-off elements are formed and/or provided on a common ring-like carrier which can be pivoted around the axis of the rotor relative to the rotor.

Another feature or aspect of an embodiment is believed at the time of the filing of this patent application to possibly reside broadly in a filling machine, characterized by the fact that in the carrier, a common duct is provided that is in communication with the shut-off elements.

Yet another feature or aspect of an embodiment is believed at the time of the filing of this patent application to possibly reside broadly in a filling machine, characterized by the fact that on the carrier there are holders or receptacles for the containers, and in particular each receptacle is offset from a shut-off element by an angular amount.

Still another feature or aspect of an embodiment is believed at the time of the filing of this patent application to possibly reside broadly in a beverage bottling plant for filling beverage bottles with a hot liquid beverage material, said beverage bottling plant comprising: a beverage bottle cleaning machine being configured and disposed to clean beverage bottles; a feed arrangement to supply beverage bottles to said beverage bottle cleaning machine; a rotatable beverage filling machine being configured and disposed to fill beverage bottles with liquid beverage material; said beverage filling machine comprising a rotor and drive mechanism to rotate said beverage filling machine about a vertical axis; at least one storage unit being configured and disposed to store a supply of liquid beverage material; at least one supply line being configured and disposed to connect said at least one storage unit to said beverage filling machine to supply liquid beverage material to said beverage filling machine; a first conveyer arrangement being configured and disposed to move beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling machine being configured and disposed to label filled, closed beverage bottles; a third conveyor arrangement being configured and disposed to move filled, closed beverage bottles from said beverage bottle closing machine into said beverage bottle labeling machine; said third conveyer arrangement comprising a star wheel structure; a beverage bottle packing station being configured and disposed to package labeled, filled, closed beverage bottles; a fourth conveyor arrangement being configured and disposed to move labeled, filled, closed beverage bottles from said beverage bottle labeling machine to said beverage bottle packing station; said fourth conveyer arrangement comprising a linear conveyor structure being configured and disposed to arrange beverage bottles in groups for packing; said beverage filling machine comprising a rotatable bottle carrier ring; said bottle carrier ring comprising a plurality of bottle holding receptacles disposed on the periphery being configured to hold bottles to be filled with heated liquid; a boiler apparatus being configured and disposed to heat liquids to be bottled; said beverage filling machine comprising a plurality of beverage filling devices for filling beverage bottles with liquid beverage material disposed on the periphery of said beverage filling machine; each of said plurality of beverage filling devices being configured and disposed to fill bottles with heated liquid; each of said plurality of beverage filling devices and comprising: a filling element being configured to dispense liquid into a bottle located below said filling element; a liquid line being configured and disposed to connect said filling element to said boiler apparatus to permit flow of heated liquid from said boiler apparatus to said filling element; a dispensing opening being configured and disposed to dispense heated liquid into a bottle; a ring-shaped protrusion disposed about said dispensing opening; a liquid duct being configured and disposed to connect said liquid line to said dispensing opening to permit flow of heated liquid; and a first liquid valve being disposed in said liquid duct; said first liquid valve being configured and disposed to control dispensing of heated liquid into bottles to be filled; said beverage filling machine comprising a return duct arrangement being configured and disposed to permit flow of heated liquid from said filling devices to said boiler apparatus upon an interruption in process of filling of bottles, said return duct arrangement comprising: a plurality of substantially cap-shaped elements, each of which being disposed on said carrier ring adjacent a corresponding one of said plurality of bottle holding receptacles; each of said plurality of substantially cap-shaped elements being configured and disposed to be moved by said carrier ring into engagement with a corresponding dispensing opening to form a passage with said corresponding dispensing opening upon an interruption in the bottling process; each of said substantially cap-shaped elements comprising an interior portion configured and disposed to receive heated liquid upon said substantially cap-shaped element being engaged with said dispensing opening; an O-ring being configured and disposed to form the edge of the opening of said substantially cap-shaped element, said O-ring comprising an elastic material; said O-ring being configured and disposed to be moved to contact and sealingly engage with said ring-shaped protrusion upon an interruption in the bottling process; a reservoir for receiving and holding heated liquid from said filling devices; and a liquid duct arrangement to permit flow of liquid from said substantially cap-shaped elements to said reservoir; and said return duct arrangement being configured to permit flow of heated liquid through said filling devices and said return duct arrangement upon an interruption in filling of bottles to essentially maintain the temperature of said filling devices and said heated liquid to essentially kill germs to essentially prevent contamination of the liquid and said filling devices.

Yet another feature or aspect of an embodiment is believed at the time of the filing of this patent application to possibly reside broadly in method of operating a beverage bottling plant for filling beverage bottles with a hot liquid beverage material, said beverage bottling plant comprising: a beverage bottle cleaning machine being configured and disposed to clean beverage bottles; a feed arrangement to supply beverage bottles to said beverage bottle cleaning machine; a rotatable beverage filling machine being configured and disposed to fill beverage bottles with liquid beverage material; said beverage filling machine comprising a rotor and drive mechanism to rotate said beverage filling machine about a vertical axis; at least one storage unit being configured and disposed to store a supply of liquid beverage material; at least one supply line being configured and disposed to connect said at least one storage unit to said beverage filling machine to supply liquid beverage material to said beverage filling machine; a first conveyer arrangement being configured and disposed to move beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling machine being configured and disposed to label filled, closed beverage bottles; a third conveyor arrangement being configured and disposed to move filled, closed beverage bottles from said beverage bottle closing machine into said beverage bottle labeling machine; said third conveyer arrangement comprising a star wheel structure; a beverage bottle packing station being configured and disposed to package labeled, filled, closed beverage bottles; a fourth conveyor arrangement being configured and disposed to move labeled, filled, closed beverage bottles from said beverage bottle labeling machine to said beverage bottle packing station; said fourth conveyer arrangement comprising a linear conveyor structure being configured and disposed to arrange beverage bottles in groups for packing; said beverage filling machine comprising a rotatable bottle carrier ring; said bottle carrier ring comprising a plurality of bottle holding receptacles disposed on the periphery being configured to hold bottles to be filled with heated liquid; a boiler apparatus being configured and disposed to heat liquids to be bottled; said beverage filling machine comprising a plurality of beverage filling devices for filling beverage bottles with liquid beverage material disposed on the periphery of said beverage filling machine; each of said plurality of beverage filling devices being configured and disposed to fill bottles with heated liquid; each of said plurality of beverage filling devices and comprising: a filling element being configured to dispense liquid into a bottle located below said filling element; a liquid line being configured and disposed to connect said filling element to said boiler apparatus to permit flow of heated liquid from said boiler apparatus to said filling element; a dispensing opening being configured and disposed to dispense heated liquid into a bottle; a ring-shaped protrusion disposed about said dispensing opening; a liquid duct being configured and disposed to connect said liquid line to said dispensing opening to permit flow of heated liquid; and a first liquid valve being disposed in said liquid duct; said first liquid valve being configured and disposed to control dispensing of heated liquid into bottles to be filled; said beverage filling machine comprising a return duct arrangement being configured and disposed to permit flow of heated liquid from said filling devices to said boiler apparatus upon an interruption in process of filling of bottles, said return duct arrangement comprising: a plurality of substantially cap-shaped elements, each of which being disposed on said carrier ring adjacent a corresponding one of said plurality of bottle holding receptacles; each of said plurality of substantially cap-shaped elements being configured and disposed to be moved by said carrier ring into engagement with a corresponding dispensing opening to form a passage with said corresponding dispensing opening upon an interruption in the bottling process; each of said substantially cap-shaped elements comprising an interior portion configured and disposed to receive heated liquid upon said substantially cap-shaped element being engaged with said dispensing opening; an O-ring being configured and disposed to form the edge of the opening of said substantially cap-shaped element, said O-ring comprising an elastic material; said O-ring being configured and disposed to be moved to contact and sealingly engage with said ring-shaped protrusion upon an interruption in the bottling process; a reservoir for receiving and holding heated liquid from said filling devices; and a liquid duct arrangement to permit flow of liquid from said substantially cap-shaped elements to said reservoir; and said return duct arrangement being configured to permit flow of heated liquid through said filling devices and said return duct arrangement upon an interruption in filling of bottles to essentially maintain the temperature of said filling devices and said heated liquid to essentially kill germs to essentially prevent contamination of the liquid and said filling devices, said method comprising the steps of: supplying beverage bottles to said beverage bottle cleaning machine; cleaning beverage bottles; transporting beverage bottles to said beverage filling machine; filling beverage bottles with liquid beverage material; transporting filled beverage bottles to said beverage bottle closing machine; closing tops of filled beverage bottles; transporting filled beverage bottles to said beverage bottle labeling machine; attaching labels onto filled beverage bottles; transporting filled beverage bottles to said beverage bottle packing station; arranging filled beverage bottles into groups of beverage bottles; packing groups of beverage bottles; upon an interruption in the filling of bottles, stopping the flow of heated liquid beverage into the bottles then moving said cap-shaped elements below corresponding dispensing openings of said filling devices; engaging with said cap-shaped elements said dispensing opens to form a seal and a path for heated liquid beverage; recirculating heated liquid beverage from said boiler into said filling devices, through said filling devices into said return duct arrangement, through said return duct arrangement into said reservoir, through said reservoir and back into said boiler to essentially maintain the temperature of said filling devices and said heated liquid to essentially kill germs to essentially prevent contamination of the liquid and said filling devices; and moving said cap-shaped elements out of engagement from said dispensing openings and moving bottle holding receptacles under said filling devices upon resuming filling of bottles.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of bottling and container handling systems and components thereof which may possibly be utilized or adapted for use in at least one possible embodiment, may possibly be found in the following U.S. patents and patent applications: U.S. Pat. No. 6,484,477, having Ser. No. 09/759,985 and entitled "Capping Machine for Capping and Closing Containers, and a Method for Closing Containers," issued on Nov. 26, 2002; U.S. Pat. No. 6,474,368, having Ser. No. 09/792,129, entitled "Beverage Container Filling Machine, and Method for Filling Containers with a Liquid Filling Material in a Beverage Container Filling Machine," issued on Nov. 5, 2002; U.S. Pat. No. 6,494,238, having Ser. No. 09/803,728, entitled "A Plant for Filling Beverage into Beverage Bottles Other Beverage Containers Having Apparatus for Replacing Remaining Air Volume in Filled Beverage Bottles or Other Beverage Containers," issued on Dec. 17, 2002; U.S. Pat. No. 6,470,922, having Ser. No. 09/808,411, entitled "Apparatus for the Recovery of an Inert Gas," issued on Oct. 29, 2002; U.S. Pat. No. 6,463,964, having Ser. No. 09/877,225, entitled "Method of Operating a Plant for Filling Bottles, Cans or the like Beverage Containers with a Beverage, and a Beverage Container Filling Machine" issued on Oct. 15, 2002; U.S. Pat. No. 6,834,473, having Ser. No. 09/942,254, entitled "Bottling Plant and Method of Operating a Bottling Plant and a Bottling Plant with Sections for Stabilizing the Bottled Product" issued on Dec. 28, 2004; U.S. Pat. No. 6,484,762, having Ser. No. 09/948,072, entitled "A Filling System with Post-dripping Prevention." issued on Nov. 26, 2002; U.S. Pat. No. 6,668,877, having Ser. No. 10/104,289, entitled "Filling System for Still Beverages," issued on Dec. 30, 2003; and in the following U.S. patent applications: Ser. No. 10/653,617, filed on Sep. 2, 2003, entitled "Labeling Machine with a Sleeve Mechanism for Preparing and Applying Cylindrical Labels onto Beverage Bottles and Other Beverage Containers in a Beverage Container Filling Plant;" Ser. No. 10/666,931, filed on Sep. 18, 2003, entitled "Beverage Bottling Plant for Filling Bottles with a Liquid Beverage Filling Material and a Labelling Station for Filled Bottles and Other Containers;" Ser. No. 10/723,451, filed on Nov. 26, 2003, entitled "Beverage Bottling Plant for Filling Beverage Bottles or Other Beverage Containers with a Liquid Beverage Filling Material and Arrangement for Dividing and Separating of a Stream of Beverage Bottles or Other Beverage Containers;" Ser. No. 10/739,895, filed on Dec. 18, 2003, entitled "Method of Operating a Beverage Container Filling Plant with a Labeling Machine for Labeling Beverage Containers Such as Bottles and Cans, and a Beverage Container Filling Plant with a Labeling Machine for Labeling Beverage Containers Such as Bottles and Cans;" Ser. No. 10/756,171, filed on Jan. 13, 2004, entitled "A Beverage Bottling Plant for Filling Bottles and like Containers with a Liquid Beverage Filling Material and a Conveyer Arrangement for Aligning and Distributing Packages Containing Filled Bottles and like Containers;" Ser. No. 10/780,280, entitled "A Beverage Bottling Plant for Filling Bottles with a Liquid Beverage Filling Material, a Container Filling Plant Container Information Adding Station, Such As, a Labeling Station, Configured to Add Information to Containers, Such As, Bottles and Cans, and Modules for Labeling Stations;" Ser. No. 10/786,256, entitled "A Beverage Bottling Plant for Filling Bottles with a Liquid Beverage Filling Material, and a Container Filling Lifting Device for Pressing Containers to Container Filling Machines;" Ser. No. 10/793,659, entitled "A Beverage Bottling Plant for Filling Bottles with a Liquid Beverage Filling Material, and a Container Filling Plant Container Information Adding Station, Such As, a Labeling Station Having a Sleeve Label Cutting Arrangement, Configured to Add Information to Containers, Such As, Bottles and Cans;" Ser. No. 10/801,924, filed on Mar. 16, 2004, entitled "Beverage Bottling Plant for Filling Bottles with a Liquid Beverage Filling Material, and a Cleaning Device for Cleaning Bottles in a Beverage Bottling Plant;" Ser. No. 10/813,651, filed on Mar. 30, 2004, entitled "A Beverage Bottling Plant for Filling Bottles with a Liquid Beverage Filling Material, and an Easily Cleaned Lifting Device in a Beverage Bottling Plant;" Ser. No. 10/814,624, filed on Mar. 31, 2004, entitled "A Beverage Bottling Plant for Filling Bottles with a Liquid Beverage Filling Material, and a Container Filling Plant Container Information Adding Station, Such As, a Labeling Station Having a Gripper Arrangement, Configured to Add Information to Containers, Such As, Bottles and Cans;" Ser. No. 10/816,787, filed on Apr. 2, 2004, entitled "A Beverage Bottling Plant for Filling Bottles with a Liquid Beverage Filling Material, and Apparatus for Attaching Carrying Grips to Containers with Filled Bottles;" Ser. No. 10/865,240, filed on Jun. 10, 2004, Entitled "A Beverage Bottling Plant for Filling Bottles with a Liquid Beverage Filling Material, a Beverage Container Filling Machine, and a Beverage Container Closing Machine;" Ser. No. 10/883,591, filed on Jul. 1, 2004, entitled "A Beverage Bottling Plant for Filling Bottles with a Liquid Beverage Filling Material Having a Container Filling Plant Container Information Adding Station, Such As, a Labeling Station, Configured to Add Information to Containers, Such As, Bottles and Cans, and Modules for Labeling Stations and a Bottling Plant Having a Mobile Module Carrier;" Ser. No. 10/930,678, filed on Aug. 31, 2004, entitled "A Beverage Bottling Plant for Filling Bottles with a Liquid Beverage Filling Material, a Container Filling Plant Container Filling Machine, and a Filter Apparatus for Filtering a Liquid Beverage;" Ser. No. 10/931,817, filed on Sep. 1, 2004, entitled "A Beverage Bottling Plant for Filling Bottles with a Liquid Beverage Filling Material, Having an Apparatus for Exchanging Operating Units Disposed at Rotating Container Handling Machines;" Ser. No. 10/939,170, filed on Sep. 10, 2004, Ser. No. 10/954,012, filed on Sep. 29, 2004, Ser. No. 10/952,706, Ser. No. 10/962,183, filed on Oct. 8, 2004, Ser. No. 10/967,016, filed on Oct. 15, 2004, Ser. No. 10/982,706, filed on Nov. 5, 2004, Ser. No. 10/982,694, Ser. No. 10/982,710, Ser. No. 10/984,677, filed on Nov. 9, 2004, Ser. No. 10/985,640, filed on Nov. 10, 2004, Ser. No. 11/004,663, filed on Dec. 3, 2004, Ser. No. 11/009,551, filed on Dec. 10, 2004, Ser. No. 11/012,859, filed on Dec. 15, 2004, Ser. No. 11/014,673, filed on Dec. 16, 2004, Ser. No. 11/016,364, filed on Dec. 17, 2004, and Ser. No. 11/016,363, The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of bottling systems that may possibly be utilized or possibly adapted for use in at least one possible embodiment of the present application may possibly be found in the following U.S. patents, all assigned to the Assignee herein, namely: U.S. Pat. Nos. 4,911,285; 4,944,830; 4,950,350; 4,976,803; 4,981,547; 5,004,518; 5,017,261; 5,062,917; 5,062,918; 5,075,123; 5,078,826; 5,087,317; 5,110,402; 5,129,984; 5,167,755; 5,174,851; 5,185,053; 5,217,538; 5,227,005; 5,413,153; 5,558,138; 5,634,500; 5,713,403; 6,276,113; 6,213,169; 6,189,578; 6,192,946; 6,374,575; 6,365,054; 6,619,016; 6,474,368; 6,494,238; 6,470,922; and 6,463,964.

All, or substantially all, of the components and methods of the various embodiments may be used with at least one embodiment or all of the embodiments, if more than one embodiment is described herein.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of sensors that may possibly be utilized or possibly adapted for use in at least one possible embodiment of the present application may possibly be found in the following U.S. patents: U.S. Pat. No. 6,062,248 issued to Boelkins on May 16, 2000; U.S. Pat. No. 6,223,593 issued to Kubisiak et al. on May 1, 2001; U.S. Pat. No. 6,466,035 issued to Nyfors et al. on Oct. 15, 2002; U.S. Pat. No. 6,584,851 issued to Yamagishi et al. on Jul. 1, 2003; U.S. Pat. No. 6,631,638 issued to James et al. on Oct. 14, 2003; and U.S. Pat. No. 6,707,307 issued to McFarlane et al. on Mar. 16, 2004.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025 issued to Yasui on Feb. 15, 2000.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of bottling systems which may possibly be utilized or adapted for use in at least one possible embodiment may possibly be found in the following U.S. patents: U.S. Pat. No. 6,684,602, entitled "Compact bottling machine;" U.S. Pat. No. 6,470,922, entitled "Bottling plant for bottling carbonated beverages;" U.S. Pat. No. 6,390,150, entitled "Drive for bottling machine;" U.S. Pat. No. 6,374,575, entitled "Bottling plant and method of operating a bottling plant;" U.S. Pat. No. 6,192,946, entitled "Bottling system;" U.S. Pat. No. 6,185,910, entitled "Method and an apparatus for high-purity bottling of beverages;" U.S. Pat. No. 6,058,985, entitled "Bottling machine with a set-up table and a set-up table for a bottling machine and a set-up table for a bottle handling machine;" U.S. Pat. No. 5,996,322, entitled "In-line bottling plant;" U.S. Pat. No. 5,896,899, entitled "Method and an apparatus for sterile bottling of beverages;" U.S. Pat. No. 5,848,515, entitled "Continuous-cycle sterile bottling plant;" U.S. Pat. No. 5,634,500, entitled "Method for bottling a liquid in bottles or similar containers;" and U.S. Pat. No. 5,425,402, entitled "Bottling system with mass filling and capping arrays."

The corresponding foreign and international patent publication applications, namely, Federal Republic of Germany Patent Application No. 10 2004 004 331.0, filed on Jan. 29, 2004, having inventors Ludwig Clüsserath, Dieter-Rudolf Krulitsch, and Volker Till, and DE-OS 10 2004 004 331.0 and DE-PS 10 2004 004 331.0, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

Some examples of starwheels which may possibly be utilized or adapted for use in at least one possible embodiment may possibly be found in the following U.S. patents: U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of seal arrangements that may possibly be utilized or possibly adapted for use in at least one possible embodiment of the present application may possibly be found in the following U.S. patents: U.S. Pat. No. 4,010,960 issued to Martin on Mar. 8, 1977; U.S. Pat. No. 5,411,273 issued to Pietsch et al. on May 2, 1995; U.S. Pat. No. 5,375,852 issued to Charhut on Dec. 27, 1994; U.S. Pat. No. 6,189,896 issued to Dickey et al. on Feb. 20, 2002: U.S. Pat. No. 6,692,007 issued to Oldenburg on Feb. 17, 2004; and U.S. Pat. No. 6,648,335 issued to Ezell on Nov. 18, 2003.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of lifting devices that may possibly be utilized or possibly adapted for use in at least one possible embodiment of the present application may possibly be found in the following patent publications: British Patent No. 1,188,888 issued Apr. 22, 1970; German Laid Open Patent Application No. DE-OS 26 52 910 published on May 24, 1978; German Patent No. DE-PS 26 52 918 issued on Oct. 26, 1978; German Utility Model No. DE-GM 83 04 995 issued on Dec. 22, 1983; German Patent No. DE-PS 26 30 100 issued on Dec. 3, 1981; and German Laid Open Patent Application No. DE-OS 195 45 080 published on Jun. 5, 1997.

The details in the patents, patent applications and publications may be considered to be incorporable, at applicant's option, into the claims during prosecution as further limitations in the claims to patentably distinguish any amended claims from any applied prior art.

The following co-pending U.S. patent application Ser. No. 10/786,256, filed on Feb. 25, 2004, having the title: A beverage bottling plant for filling bottles with a liquid beverage filling material, and a container filling lifting device for pressing containers to container filling machines, having inventor Herbert BERNHARD, and is hereby incorporated by reference as if set forth in its entirety herein.

The following co-pending U.S. patent application Ser. No. 10/813,651 filed on Mar. 30, 2004, having the title: A beverage bottling plant for filling bottles with a liquid beverage filling material, and an easily cleaned lifting device in a beverage bottling plant, having inventor Herbert BERNHARD, and is hereby incorporated by reference as if set forth in its entirety herein.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

NOMENCLATURE

1, 1*a* Filling machine
2 Bottle
3 Rotor
4, 4*a* Filling element
5, 5*a* Liquid duct
6 Line
7 Boiler
8 Dispensing opening
9 Liquid valve
10 Actuator element
11 Control device
12 Measurement instrument
13 Container carrier
14 Receptacle
15 Reservoir
15.1 Liquid delivery pump
16 Heater
17 Shut-off element
18 O-ring
19 Interior of the shut-off element
20 Duct
21 Ring duct
22 Line
23 Bearing element
24 Ring bead
25, 26 Liquid valve
27, 28 Shutoff valve
29 Line for cleaning fluid
VA Vertical machine axis
N Level

What is claimed is:

1. Method for the hot bottling of a liquid in bottles, kegs or similar containers using a filling machine that has a plurality of filling elements, each of which has a liquid duct that ends at a dispensing opening and has at least one liquid valve for the controlled dispensing of the hot liquid being bottled to a container which is located on the filling element, characterized by the fact that to reduce the cooling at least of the liquid being bottled in the filling elements and/or to prevent the cooling at least of the filling elements during an interruption of the filling process, the liquid being bottled is substantially continuously conveyed in the hot condition in a circuit comprising at least one flow path that includes said filling element and/or its liquid ducts from a source for the hot liquid being bottled to a reservoir that receives the liquid being bottled.

2. Method as claimed in claim 1, characterized by the fact that to prevent the cooling of at least the liquid being bottled in the filling elements and/or to prevent a cooling at least of the filling elements during an interruption of the filling process, the liquid being bottled is transported hot in a circuit that encloses the flow path inside the machine.

3. Method as claimed in claim 2, characterized by the fact that the liquid source used is a liquid boiler of the filling machine, which boiler is in communication with the filling elements.

4. Method as claimed in claim 3, characterized by the fact that a reservoir is used as a well for the liquid being bottled, in addition to the liquid boiler.

5. Method as claimed in claim 4, characterized by the fact that the liquid being bottled is fed from the liquid source out of the liquid well via at least one heater.

6. Method as claimed in claim 5, characterized by the fact that the filling elements, to form at least one flow path, are connected by means of their liquid duct.

7. Method as claimed in claim 6, characterized by the fact that the filling elements for the formation of the at least one flow path are each closed on their dispensing openings by means of a shut-off element.

8. Method as claimed in claim 7, characterized by the fact that the filling elements are connected via the shut-off elements with the liquid well or with the duct connected to this well.

9. Method as claimed in claim 8, characterized by the fact that the at least one flow path is a flow path inside the machine.

10. A method for the hot bottling of a liquid in bottles, kegs or similar containers using a filling machine comprising: a plurality of filling elements; each of said filling elements comprising a liquid duct, a dispensing opening disposed at the end of said liquid duct, and at least one liquid valve disposed in said liquid duct being configured to control dispensing of the hot liquid being bottled to a container; a liquid source being configured and disposed to supply liquid to said filling elements; and a reservoir being configured and disposed to receive liquid from said liquid source; wherein said method comprises the steps of:

filling beverage bottles with liquid beverage material;

upon an interruption in the filling of bottles, stopping the flow of heated liquid beverage into the bottles;

recirculating heated liquid beverage from said liquid beverage into said filling elements, through said filling elements and into said reservoir, through said reservoir and back into said liquid source to essentially maintain the temperature of at least one of: said filling devices and said heated liquid; and resuming filling of bottles upon termination of the interruption in the filling of bottles.

11. The method as claimed in claim 10, wherein to prevent the cooling of at least the liquid being bottled in the filling elements and/or to prevent a cooling at least of the filling elements during an interruption of the filling process, the liquid being bottled is transported hot in a circuit that encloses the flow path inside the filling machine.

12. The method as claimed in claim 11, wherein the liquid source comprises a liquid boiler of said filling machine, which said boiler is in communication with the filling elements via connecting lines.

13. The method as claimed in claim 12, wherein the reservoir comprises a liquid well for the liquid being bottled.

14. The method as claimed in claim 13, wherein the liquid being bottled is fed from said liquid source out of said liquid well via at least one heater.

15. The method as claimed in claim 14, wherein said filling elements, to form at least one flow path, are connected by means of their liquid duct.

16. The method as claimed in claim 15, wherein said filling elements, for the formation of the at least one flow path, are each closed on their dispensing openings by means of a shut-off element.

17. The method as claimed in claim 16, wherein said filling elements are connected via said shut-off elements with said liquid well or with said duct connected to said well.

18. The method as claimed in claim 17, wherein said at least one flow path in question is a flow path inside said filling machine.

19. A method for the hot bottling of a liquid in bottles, kegs, or similar containers using a rotatable beverage filling machine being configured and disposed to fill beverage bottles with liquid beverage material; said beverage filling machine comprising a rotatable bottle carrier ring; said bottle carrier ring comprising a plurality of bottle holding receptacles disposed on the periphery being configured to hold bottles to be filled with heated liquid; a boiler apparatus being configured and disposed to heat liquids to be bottled; said beverage filling machine comprising a plurality of beverage filling devices for filling beverage bottles with liquid beverage material disposed on the periphery of said beverage filling machine; each of said plurality of beverage filling devices being configured and disposed to fill bottles with heated liquid; each of said plurality of beverage filling devices comprising: a filling element being configured to dispense liquid into a bottle located below said filling element; said filling element comprising: a dispensing opening being configured and disposed to dispense heated liquid into a bottle; a liquid duct being configured and disposed to connect a liquid supply line to said dispensing opening to permit flow of heated liquid; and a first liquid valve being disposed in said liquid duct; said first liquid valve being configured and disposed to control dispensing of heated liquid into bottles to be filled; said beverage filling machine comprising a return duct arrangement being configured and disposed to permit flow of heated liquid from said filling devices to said boiler apparatus upon an interruption in process of filling of bottles, said return duct arrangement comprising: a plurality of substantially cap-shaped elements, each of which being disposed on said carrier ring adjacent a corresponding one of said plurality of bottle holding receptacles; each of said plurality of substantially cap-shaped elements being configured and disposed to be moved by said carrier ring into engagement with a corresponding dispensing opening to form a passage with said corresponding dispensing opening upon an interruption in the bottling process; each of said substantially cap-shaped elements comprising an interior portion configured and disposed to receive heated liquid upon said substantially cap-shaped element being engaged with said dispensing opening; an O-ring being configured and disposed to form the edge of the opening of said substantially cap-shaped element, said O-ring comprising an elastic material; said O-ring being configured and disposed to be moved to contact and sealingly engage with said ring-shaped protrusion upon an interruption in the bottling process; a reservoir for receiving and holding heated liquid from said filling devices; and a liquid duct arrangement to permit flow of liquid from said substantially cap-shaped elements to said reservoir; and said return duct arrangement being configured to permit flow of heated liquid through said filling devices and said return duct arrangement upon an interruption in filling of bottles to essentially maintain the temperature of said filling devices and said heated liquid to essentially kill germs to essentially prevent contamination of the liquid and said filling devices, said method comprising the steps of:

filling beverage bottles with liquid beverage material;

upon an interruption in the filling of bottles, stopping the flow of heated liquid beverage into the bottles, then moving said cap-shaped elements below corresponding dispensing openings of said filling devices;

engaging with said cap-shaped elements said dispensing openings to form a seal and a path for heated liquid beverage;

recirculating heated liquid beverage from said boiler into said filling devices, through said filling devices into said return duct arrangement, through said return duct arrangement into said reservoir, through said reservoir and back into said boiler to essentially maintain the temperature of said filling devices and said heated liquid to essentially kill germs to essentially prevent contamination of the liquid and said filling devices; and moving said cap-shaped elements out of engagement from said dispensing openings and moving bottle holding receptacles under said filling devices upon resuming filling of bottles.

20. The method as claimed in claim 19, wherein:

to prevent the cooling of at least the liquid being bottled in the filling elements and/or to prevent a cooling at least of the filling elements during an interruption of the filling process, the liquid being bottled is transported hot in a circuit that encloses the flow path inside the filling machine.

* * * * *